United States Patent [19]

Brejcha

[11] 4,319,434

[45] * Mar. 16, 1982

[54] SURFACE PROCESSING MACHINE

[75] Inventor: Robert J. Brejcha, Westchester, Ill.

[73] Assignee: R/B Manufacturing, Inc., Westchester, Ill.

[ * ] Notice: The portion of the term of this patent subsequent to May 22, 1996, has been disclaimed.

[21] Appl. No.: 147,560

[22] Filed: May 8, 1980

[51] Int. Cl.[3] ..... B24B 23/00

[52] U.S. Cl. ..... 51/177; 15/49 R; 299/40

[58] Field of Search ..... 51/177, 120; 299/40; 15/49 R, 50 R

[56] References Cited

U.S. PATENT DOCUMENTS

| | | | |
|---|---|---|---|
| Re. 19,613 | 6/1935 | Meyers | 51/177 |
| 1,312,235 | 8/1919 | Cavicchi | 51/177 |
| 2,316,886 | 4/1943 | Pascucci | 51/177 |
| 2,419,926 | 4/1947 | Waldron | 51/120 |
| 2,930,056 | 3/1960 | Lappin | 51/177 |
| 3,701,221 | 10/1972 | Vinella | 51/177 |
| 4,155,596 | 5/1979 | Brejcha | 51/177 X |

FOREIGN PATENT DOCUMENTS

| | | | |
|---|---|---|---|
| 737766 | 12/1932 | France | 51/177 |

*Primary Examiner*—Harold D. Whitehead

*Attorney, Agent, or Firm*—Dulin & Thienpont, Ltd.

[57] ABSTRACT

A surface processing machine including at least one motor-driven spider arm assembly each of the arms of the spider having rotatably mounted as the ends thereof a surface processing tool such as a brush, buffing pad, grinding stone or the like and wherein the surface processing tools are mounted on an axis which is substantially parallel to the axis of rotation of the spider arm assembly and further including in the case of coaxially disposed spider assemblies a flexible coupling device which not only allows for planar flexibility between the spiders but also is effective to assure that the vertical loads transmitted to all of the surface processing tools connected to each of the spider arms are evenly distributed to each of the surface processing tools.

16 Claims, 9 Drawing Figures

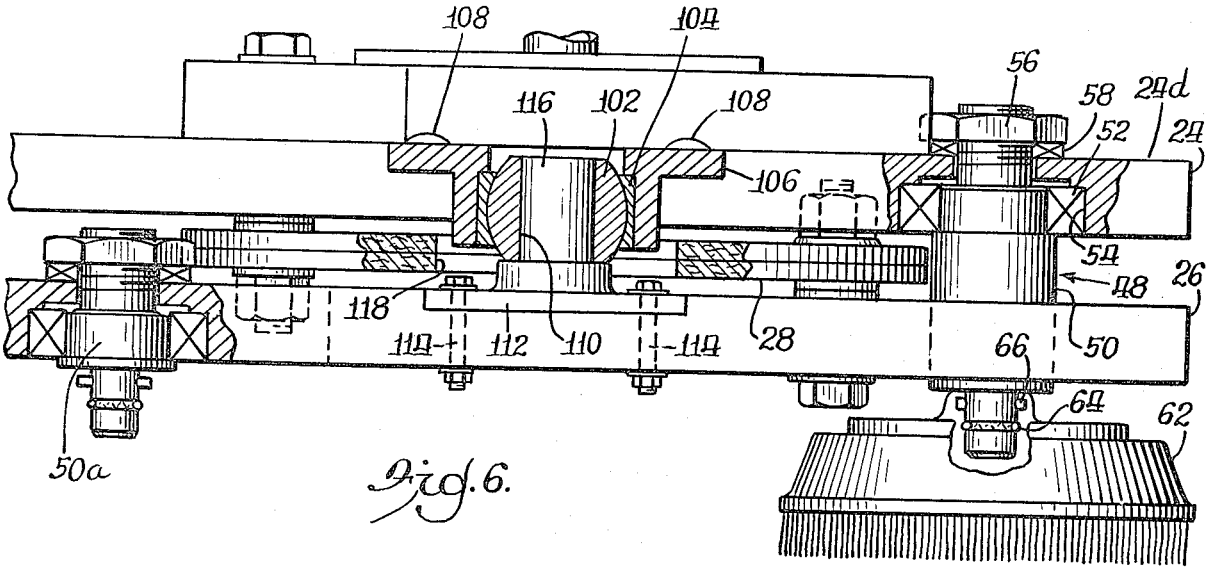
Fig. 6.
Fig. 9.
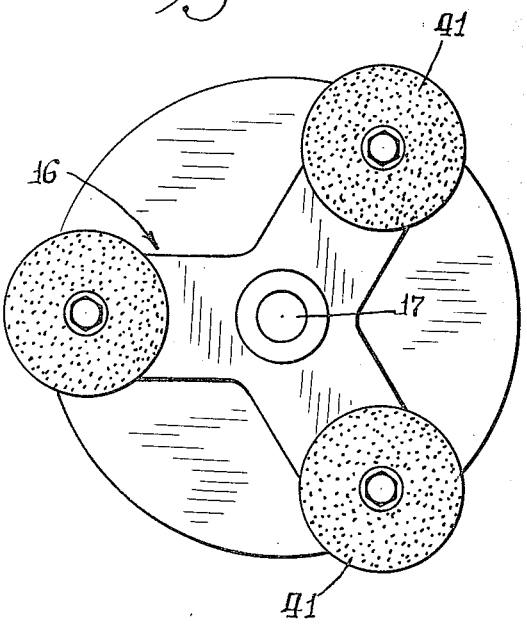
Fig. 8.
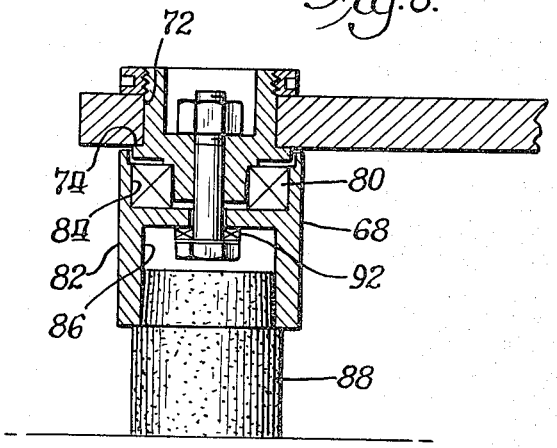
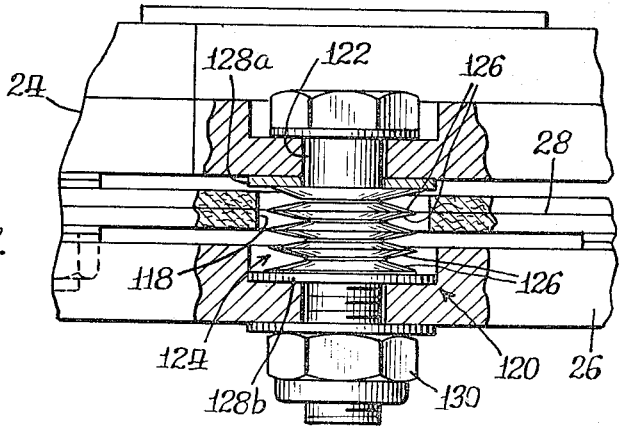
Fig. 7.

SURFACE PROCESSING MACHINE

BACKGROUND OF THE INVENTION

This invention relates to surface processing machines which may be used in conducting various surface processing operations such as for example, as the scrubbing, buffing, grinding or polishing of floor surfaces or similar, essentially continuous surfaces.

One of the problems in conventional single circular brush or buffer type machines is that often only a low percentage of the total tool area is in actual physical contact with the floor because of the inherent unevenness or waviness of a common floor together with a lack of flatness of the working face of the brush, buffing pad or other tool being used. More effective working contact can be made by using a plurality of smaller brushes or pads in such surface scrubber, buffer, grinder or polishing machines.

SUMMARY OF THE INVENTION

A principal object of this invention is to provide on a rotatable spider assembly tools carried on the ends of the spider arms which are rotatable on their own axes which are substantially parallel to the axis of the spider assembly.

Another object of the invention is to provide in surface processing apparatus including a pair of coaxially disposed spiders, flexible coupling means which will allow for planar flexibility between the spiders and allow substantially equal vertical load distribution to each of the tools connected to the spider arms.

Another object of the invention is to provide in surface processing apparatus including a plurality of coaxially disposed spiders a flexible coupling means for interconnecting the spiders which includes one or more Belleville spring washers.

Another object of the invention is to provide in surface processing apparatus including a plurality of coaxially disposed spiders a flexible coupling means for interconnecting the spiders which includes a mono-ball bearing means.

Other objects and advantages of the invention will become more apparent from the following description and accompanying drawings.

In my U.S. Pat. No. 4,155,596 issued on May 22, 1979, I disclosed the use of rotatable coaxially disposed three-arm spiders carrying at the ends thereof tools for finishing cementitious or similar brittle surfaces. The structure described herein embodies in part coaxially disposed spiders but is further improved in that tool members disposed at the outer periphery of the spider arms are freely rotatable about their own axes as well as describing an orbit about the axis of the spider assembly. In addition another improvement has been incorporated relating to the coupling means for coupling two or more coaxially disposed spiders. In connection with the flexible coupling of the type disclosed in my U.S. Pat. No. 4,155,596 I now use an additional means for coupling coaxially disposed spider assemblies whereby vertical loading on the spider assemblies is such that the load is distributed substantially equally to each of the processing tools disposed at the ends of the spider arms.

DETAILED DESCRIPTION OF THE DRAWINGS

FIG. 6 is a partial sectional view in elevation of a pair of coaxially disposed spiders showing another manner of mounting a rotatable tool assembly on the end of a spider arm and also a mono-ball bearing coupling as part of the coupling means coupling the coaxially disposed spiders;

FIG. 7 is a partial sectional view in elevation showing a coupling means for two coaxially disposed spiders including a plurality of Belleville spring washers in the coupling means;

FIG. 8 is a sectional view in elevation of another type of mounting for a freely rotating grinding tool member mounted at the end of a spider arm as contemplated by the invention herein; and FIG. 9 is a bottom plan view of a single three-arm spider including rotating surface processing tools at the ends of the spider arms.

DESCRIPTION OF PREFERRED EMBODIMENTS

Figure 1:
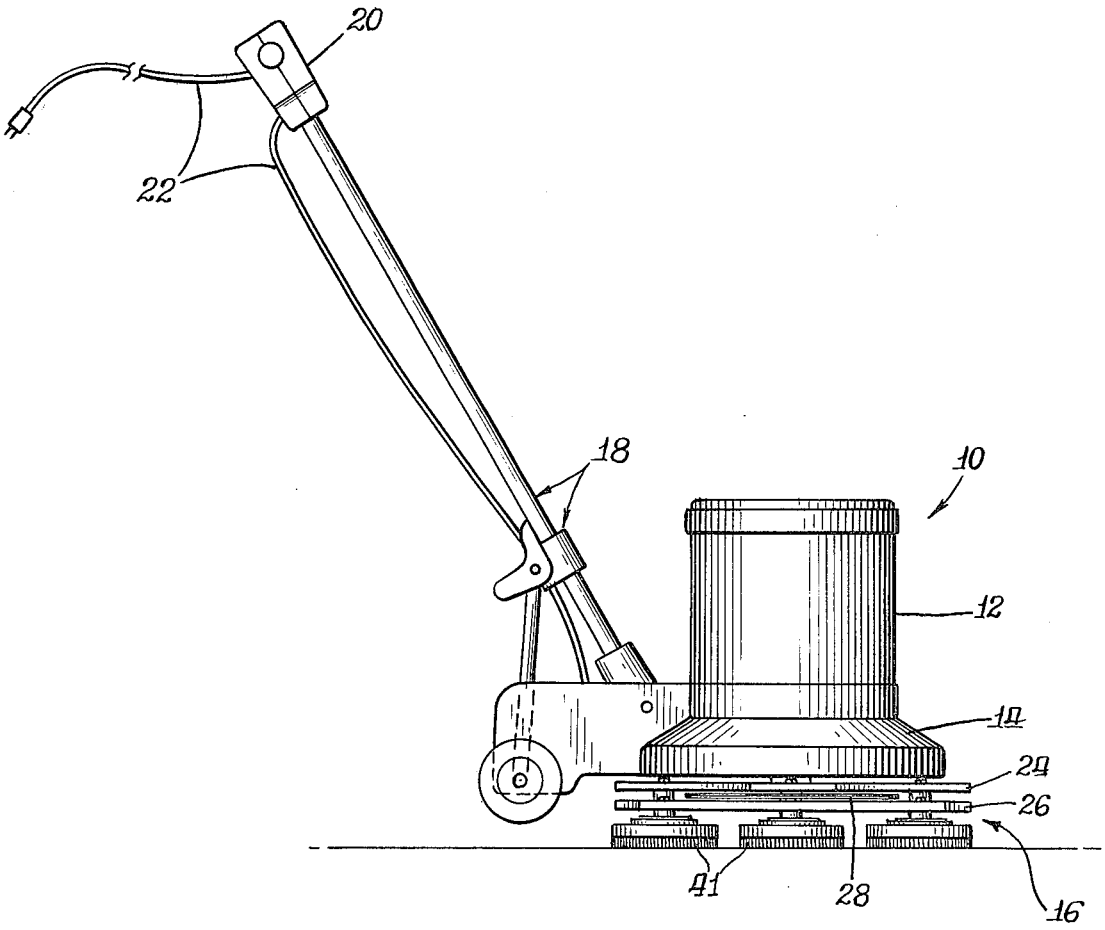
FIG. 1 is a side view in elevation of a surface processing machine embodying the invention herein.

We refer now to the drawings wherein like reference characters in the several views indicate similar parts.

FIG. 1 illustrates a surface processing machine 10. It comprises generally a motor carrying frame 12, a motor drive unit 14, generally a gear reduction, carried within the frame 12, a surface processing assembly 16 drivingly attached to the motor drive unit, a handle mechanism 18 for manipulating the machine, an electrical control unit 20 attached to the upper end of the handle mechanism, and an electrical cord 22 connected into the control unit and adapted to be connected to a source of power for providing power to the motor which is connected to the control unit by appropriate wiring not shown.

Figure 2:
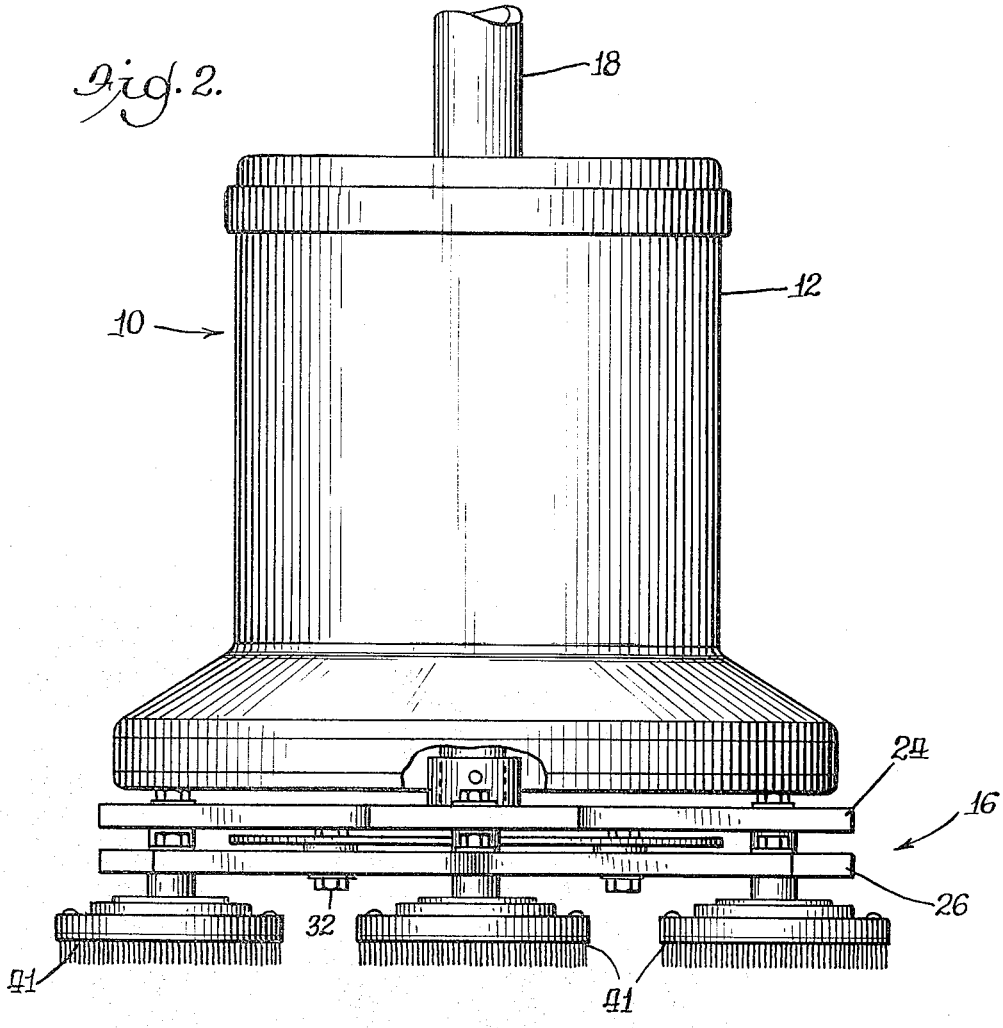
FIG. 2 is an enlarged front view in elevation of a portion of the machine shown in FIG. 1.

An enlarged partial front view of the surface processing machine 10 is shown in FIG. 2. This Fig. shows in more detail a machine carrying a plurality of brushes for processing a floor or other type surface.

Figure 3:
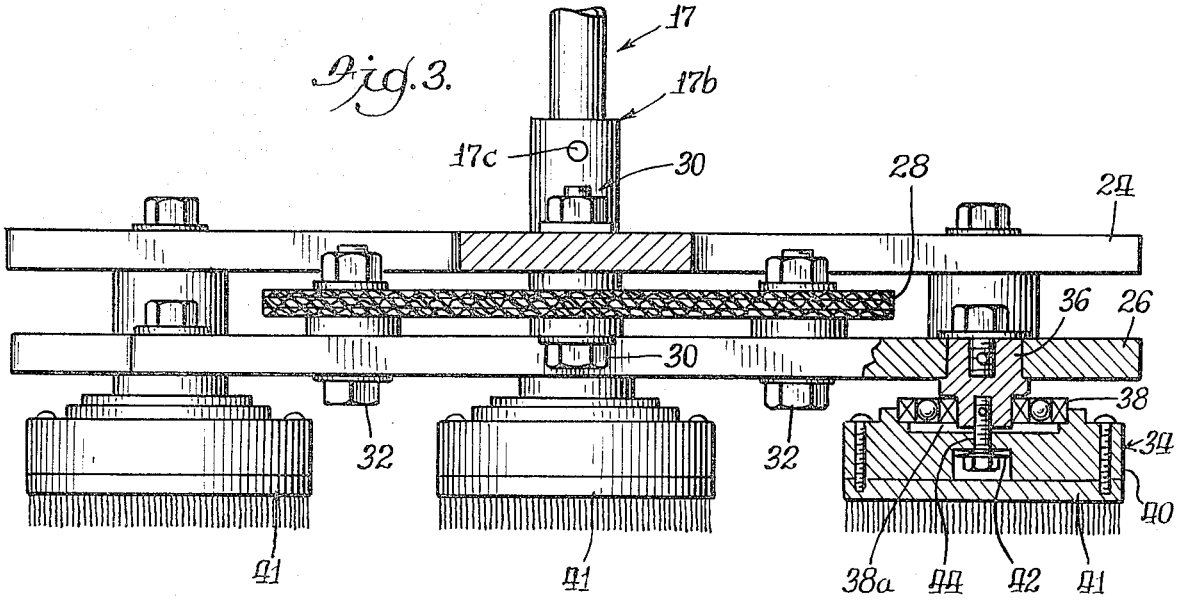
FIG. 3 is a partial view in elevation of a portion of a surface processing machine taken along line 3—3 of FIG. 4 and showing coaxially disposed spiders having arms of equal length and carrying on the arms thereof freely rotatable tool assemblies.

The surface processing assembly 16 as shown in both FIGS. 2 and 3 may be connected to the motor drive shaft 17 by engagement within a tubular member **17*b* rigidly attached to the upper portion of the surface processing assembly and pinned thereto by pin 17*c* as shown in FIG. 3**. The motor drive unit may be a planetary gear type motor or a conventional type gear motor.

Figure 4:
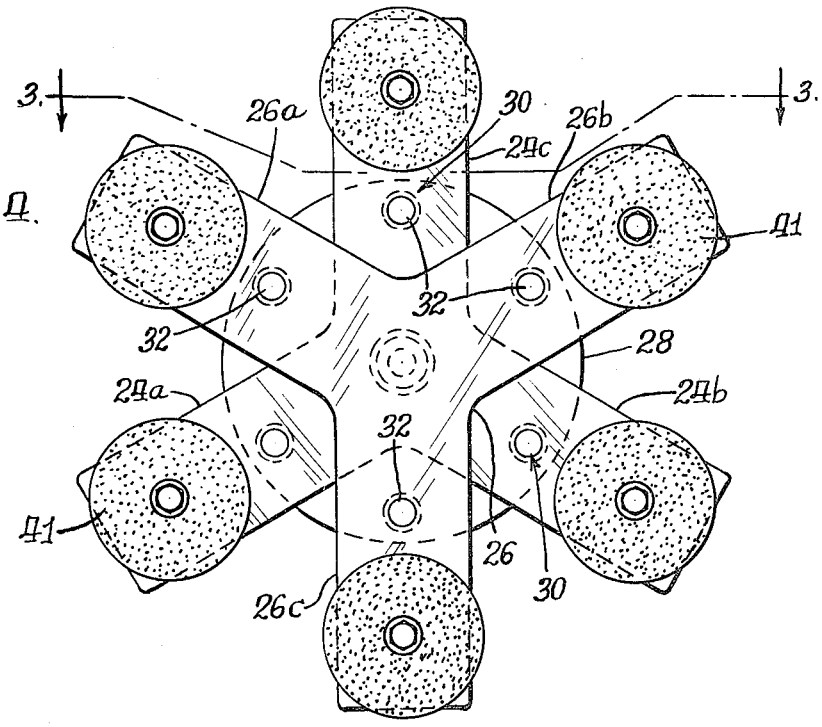
FIG. 4 is a bottom plan view of a pair of coaxially disposed three-arm spiders with arms of equal length carrying scrubbing tools or brushes as shown in FIG. 3.

The surface processing assembly 16 as shown in FIGS. 2, 3 and 4 comprise a pair of coaxially disposed upper and lower three-arm spiders 24 and 26. The upper spider 24 is formed with three equiangular spaced arms **24*a*, 24*b* and 24*c*, and the lower spider also is formed with the equiangular spaced arms 26***a*, 26*b* and 26*c*. The two spiders are interconnected by flexible coupling means. In the embodiment illustrated in FIG. 3 the interconnection is by means of a flexible coupling which may be constructed in part of a conventional rubberized canvas plate assembly 28. Bolts 30 fasten the upper spider 24 to the flexible coupling plate assembly 28. Bolts 32 fasten the lower spider 26 to the flexible coupling plate assembly 28. Such a construction is described in my U.S. Pat. No. 4,155,596.

Figure 5:
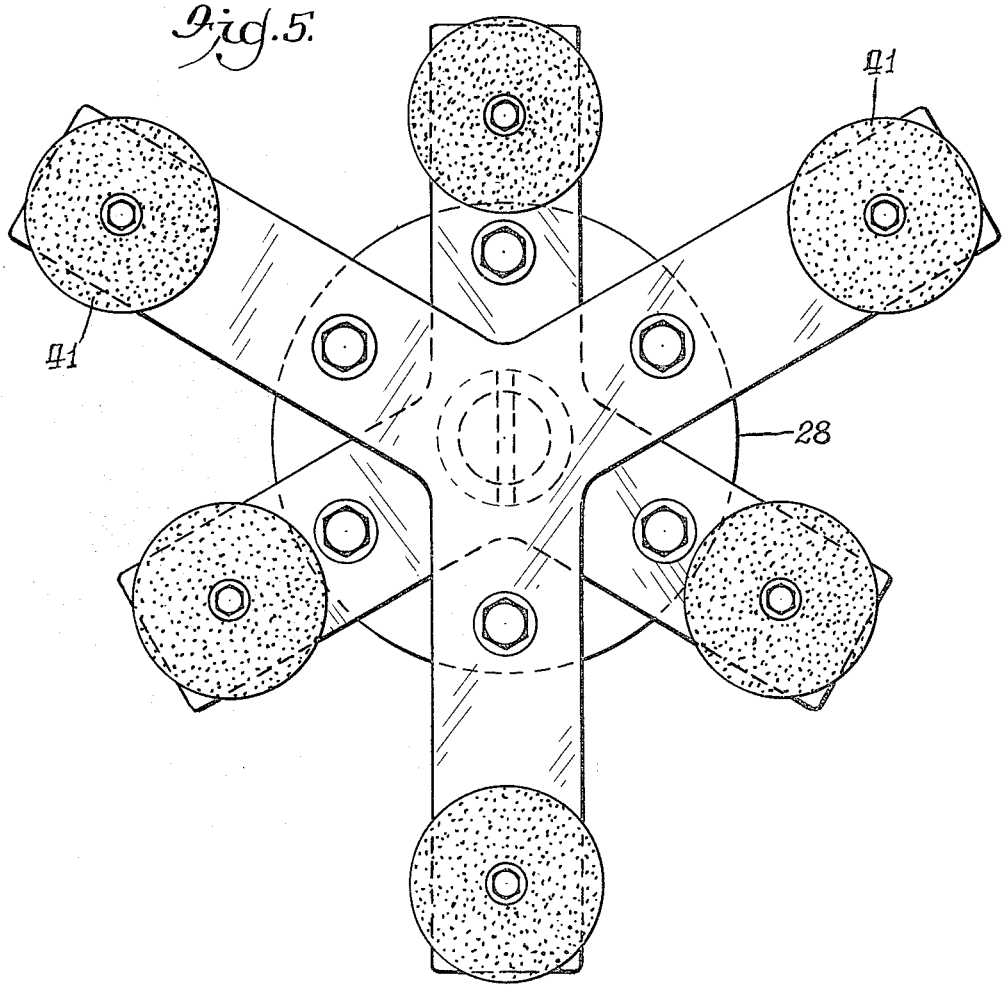
FIG. 5 is a bottom plan view of a pair of coaxially disposed tool carrying three-arm spiders with arms of unequal length carrying scrub brush members as shown in FIGS. 2 and 3.

FIGS. 4 and 5 both illustrate coaxially disposed spider assemblies. FIG. 4 illustrates a pair of three-arm spiders in which the spider arms are all of equal length with the tool assemblies on the spider arm being disposed at equal distances from the center of the spider arm assembly. Such an arrangement is shown in FIGS. 2 and 3.

FIG. 5 illustrates a pair of coaxially disposed spiders wherein the arms of one spider are of greater length than the arms of the other spider. With this arrangement the processing tools obviously can cover a greater amount of surface with each 360 degrees of rotation of the spiders than is the case with equal length spider arms.

In the invention herein, a surface processing tool assembly is rotatably mounted at the end of each spider arm. One such processing tool assembly 34 is shown in detail in FIG. 3. The tool assembly 34 comprises a stationary hub 36 connected to one of the arms of the spider 26, ball bearing means 38 the inner race 38*a* of which is attached to the lower end of the stationary hub, and a tool holder 40 carrying a circular scrub brush 41 connected to the ball bearing means 38 so that the tool holder 40 can freely rotate on its own axis. A thrust bearing 42 is disposed between the tool holder and bolt head of the selflocking bolt 44 which secures the tool holder to the hub which is connected to the spider arm.

The hub of the surface processing tool assembly connected to the upper spider means needs to be longer, of course, so that the working surface of all of the scrubber tools will be at the same height, i.e., be in the same plane.

It will be appreciated that the surface processing tool itself could be any one of a variety of items—a scrub brush, a buffing or polishing pad, a steel wool pad or even a grinding stone as hereinafter referred to in more detail.

A second embodiment of a tool assembly is shown in FIG. 6 as element 48 mounted on a spider arm of the upper three-arm spider. The tool assembly 48 comprises a shaft 50 which extends through the spider arm is rotatably supported in bearing means. A roller bearing 52 is disposed in a recess 54 formed in the lower side of the upper spider arm. A lock nut 56 is screwed onto the upper threaded end of the shaft 50 to secure the shaft in place and provide an axial loading of the bearings. A thrust bearing 58 is disposed between the lock nut 56 and the upper side 24*d* of the spider arm. A shoulder 60 formed on the shaft 50 fits up against the inner race of bearing 52 which may be either a radial roller or ball bearing. A brush tool 62 is attached to the lower end of shaft 50 by means of a spring ball detent arrangement 64 and keyed to the shaft by a pin 66. It will be apparent that tightening down on the lock nut 56 will secure the tool carrying shaft 50 in place while permitting free rotation thereof in association with the bearing 52 and thrust bearing 58.

The shafts 50 and 50*a* on the upper and lower spider arms respectively differ only in their lengths but otherwise the tool assemblies connected to the upper and lower spider arms are the same.

The invention herein is applicable to not only brush or buffing type surface processing tools. It is also applicable where the surface processing requires the use of grinding stones. Such stones, for example, might be of the silica carbide type which are often used in grinding or polishing terrazzo or other continuous surfaces. Small freely rotating grinding stones present a constantly charging direction of movement for each abrasive particle as it contacts the floor surface and thus promotes improved cutting action by the grinding stone particles. In addition, the rotating action deters loading and clogging of the abrasive stone. If the clogging of the stone is reduced this further improves the cutting action of the stone.

A third embodiment of a surface processing tool assembly 68 is shown in FIG. 8 and is particularly applicable where a grinding stone is the surface processing tool being used. The tool assembly 68 comprises a hub member 70 which is fitted into bore 72 in the end of a spider arm. The hub member 70 is formed with a shoulder 74 which seats on the underside of the spider arm, and a lock nut 76 secures the hub member in place. The lower end of the hub member 70 is formed with a boss 78 on which is seated the inner race of a bearing 80. A tool holder 82 is formed with a recess 84 on its upper end, and in this recess 84 the outer race of bearing 80 is tightly positioned. The lower half of tool holder 82 is formed with another recess 86 which may be tapered and is adapted to receive therein a grinding stone 88. This grinding stone may be similarly tapered at its upper end so that it may be tightly inserted into the recess 86 in the form of a locking taper fit. The stone is normally held in place by the normal load of the machine to which the spider arrangement is attached. A bolt 90 attaches the tool holder 92 to the hub member 70. A small thrust bearing 92 is positioned between the head of bolt 90 and the bottom of recess 86. Thus the tool holder 82 and grinding stone 88 inserted therein may rotate freely on the bearings 80 and 92.

Such a grinding stone, if used in a terrazzo grinding process, for example, may be approximately $2\frac{1}{4}''$ in diameter and approximately $2\frac{1}{2}''$ long.

It will be appreciated that each of the processing tool assemblies as shown in FIGS. 3, 6 and 8 can be used on the spider arms of a unit which includes only one three-arm spider a bottom view of which is shown in FIG. 9 or a plurality of three-arm spiders in coaxial disposition or a plurality of spiders disposed in a side by side relation and having their axes of rotation parallel to each other.

Because of the nature and manner of operation of the surface processing tools contemplated by the invention herein it is preferable to include as part of the flexible coupling means another coupling structure in addition to the conventional rubberized canvas plate assembly 28 referred to above. Such additional coupling means contemplates a structure which will be effective to permit transmission of vertical loads to all the processing tools such as, for example, scrubbers, brushes, buffing pads or grinding stones in a manner such that the load will be distributed to each of these processing tools substantially equally.

One such coupling means is shown in FIG. 6 as a mono-ball bearing coupling structure 100. It comprises an inner spherical ball 102 secured in a support collar 104 which in turn is secured in a bearing retainer 106 by a press fit. The bearing retainer 106 extends through the upper spider 24 and is seated in and secured in the upper spider 24 by means of bolts 108 or other suitable means. A bore 110 is formed through the center of the ball bearing 102. A flange member 112 is secured onto the lower spider 26 by means of bolts 114 and has secured thereto a shaft 116 which extends into the bore 110 of the ball 102. Thus the flange member 112 provides an assembly of the mono-ball bearing to the lower spider 26 and the bearing retainer 106 provides an assembly of the mono-ball bearing to the upper spider 24. In providing the interconnection between the upper and lower spiders the mono-ball bearing coupling structure extends through an opening 118 in the canvas plate assembly 28 and acts as a spherical ball and socket assembly. A certain amount of vertical adjustment of the vertical spacing between the spiders may be made by the use of shims in association with either or both of the bearing retainer 106 and flange member 112.

Another type of additional coupling means is shown in FIG. 7 as a pack assembly of Belleville spring washers. This Belleville spring washer coupling unit 120 comprises a bolt 122, a spring back 124 including a plurality of Belleville washers 126 supported on the bolt 122, washers 128*a* and 128*b* disposed on the bolt 122 at each end of the spring back 124 and locknut 130 on the end of bolt 122. The bolt 122, of course, extends through the upper and lower spiders 24 and 26 and through the opening 118 in the canvas plate assembly 28. This particular coupling arrangement is adjustable by loosening or tightening the nut 130. As is well known the Belleville spring washers are flexible and accordingly adjustment of distance between the spiders is easily accomplished by adjusting the nut 130. In addition, Belleville spring washers may be added to or removed from the spring pack as desired.

Use of either the mono-ball bearing or Belleville spring washer coupling means assures that substantially equal vertical loading is transmitted to all the processing tools disposed at the ends of the spider arms, and it is not necessary to depend on the flexible discs of the canvas plate assembly 28 to transmit proper vertical load.

With respect to the flexible coupling devices as shown in FIGS. 6 and 7, i.e., the mono-ball bearing and Belleville spring pack, these devices also could be used in units which include more than two coaxially disposed spiders. Furthermore, these same coupling devices can be used whether the spider arms are of equal or unequal length as shown in FIGS. 4 and 5 respectively.

The arrangement described herein, using small diameter rotating tools advantageously allows each tool to be in complete relatively intimate contact with the surface at all times. Furthermore, the loading, whether by the weight of the machine alone or by other induced loading is evenly distributed over each of the tools. By contrast, in conventional single circular brush or buffer type machines where the tool is of a relatively large diameter, not all of the total tool area is normally in actual physical contact with the floor because of the non-flatness of the floor area and the fact that the faces of the tools, such as brushes or buffing pads, also are not perfectly flat. Use of a group or multiple groups of three smaller tools thus allows for a higher unit pressure to be exerted.

It will be apparent that I have advantageously provided an improved surface processing apparatus which utilizes tool assemblies rotatably mounted at the ends of the rotating spider arms on axes which are substantially parallel to the axis of rotation of the spider assembly. Furthermore, where more than one spider is used and the spiders are disposed in a coaxial relationship an improved coupling means is utilized whereby substantially equal vertical loading is transmitted to all the processing tools.

While certain preferred embodiments of the invention have been disclosed, it will be appreciated that these are shown by way of example only, and the invention is not to be limited thereto as other variations will be apparent to those skilled in the art and the invention is to be given its fullest possible interpretation within the terms of the following claims.

What is claimed is:

1. An apparatus for processing a surface comprising:
motor drive means mounted on a frame for rotatably driving a surface processing assembly;
a surface processing assembly connected to said motor drive means, said surface processing assembly including
a pair of coaxially disposed and interconnected three-arm spiders;
flexible coupling means interconnecting said pair of spiders,
a surface processing tool rotatably connected to the end of each spider arm,
means for freely rotatably mounting each of said surface processing tools at the end of each spider arm on an axis substantially parallel to the axis of rotation of said surface processing assembly.

2. The apparatus of claim 1 wherein
said surface processing tool is a rotating brush.

3. The apparatus of claim 1 wherein
said surface processing tool is a buffing or polishing pad.

4. The apparatus of claim 1 wherein said surface processing tool is a grinding stone.

5. The apparatus of claim 1 wherein
said flexible coupling means includes Belleville spring washer means disposed at the center of said pair of coaxially disposed spiders.

6. The apparatus of claim 1 wherein said flexible coupling means includes.
a mono-ball bearing disposed at the center of said pair of coaxially disposed spiders.

7. The apparatus of claim 1 wherein said flexible coupling means includes
a first flexible coupling structure for allowing planar flexibility between said coaxially disposed spiders, and
a second flexible coupling structure for assuring that the vertical loads transmitted to all of the surface processing tools connected to the spider arms are substantially equal.

8. The apparatus of claim 7 wherein
said second flexible coupling means comprises Belleville spring washer means disposed at the center of and forming part of the interconnection between said coaxially disposed spiders.

9. The apparatus of claim 7 wherein
said second flexible coupling means comprises a mono-ball bearing disposed at the center of and forming part of the interconnection between said coaxially disposed spiders.

10. An apparatus for processing a surface comprising:
motor drive means mounted on a frame for rotatably driving a surface processing assembly;
a surface processing assembly connected to said motor drive means, said surface processing assembly including
a pair of coaxially disposed and interconnected three-arm spiders;
a surface processing tool assembly connected to the end of each spider arm;
flexible coupling means interconnecting said pair of spiders, said coupling means comprising first and second coupling structures;
said first coupling structure including means for allowing planar flexibility between said coaxially disposed spiders, and
said second coupling structure including means for assuring that the vertical loads transmitted to all of the surface processing tools connected to each of the spider arms are substantially equal.

11. The apparatus of claim 10 wherein
said second coupling structure includes Belleville spring washer means disposed at the center of and forming part of the interconnection between said coaxially disposed spiders.

12. The apparatus of claim 10 wherein
said second coupling structure includes a mono-ball bearing disposed at the center of and forming part of the interconnection between said coaxially disposed spiders.

13. In an apparatus for processing a surface the combination comprising:
a surface processing assembly adapted to be connected to a motor drive means to be driven thereby, said surface processing assembly including
a pair of coaxially disposed and interconnected three-arm spiders;
a surface processing tool assembly connected to the end of each spider arm;
flexible coupling means interconnecting said pair of spiders;
said coupling means comprising first and second coupling structures,
said first coupling structure including means for allowing planar flexibility between said coaxially disposed spiders, and
said second coupling structure including means for assuring that the vertical loads transmitted to the surface processing tools connected to each of spider arms are substantially equal.

14. The combination of claim 13 wherein
said second coupling structure includes Belleville spring washer means disposed at the center of and forming part of the interconnection between said coaxially disposed spiders.

15. The combination of claim 13 wherein
said second coupling structure includes a mono-ball bearing assembly disposed at the center of and forming part of the interconnection between said coaxially disposed spiders.

16. The combination of claim 13 including
means for rotatably mounting each of said surface processing tools at the end of each spider arm on an axis substantially parallel to the axis of rotation of said surface processing assembly.

* * * * *